US006220894B1

(12) United States Patent
Bigotto et al.

(10) Patent No.: US 6,220,894 B1
(45) Date of Patent: Apr. 24, 2001

(54) ELECTRIC CONNECTOR AND ELECTRIC CONNECTING UNIT FEATURING SUCH A CONNECTOR

(75) Inventors: Pier Carlo Bigotto, Cascine Vica Rivoli; Renzo Rampone, Moncalieri, both of (IT)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/426,974

(22) Filed: Oct. 26, 1999

(30) Foreign Application Priority Data

Oct. 27, 1998 (IT) ..... 98/00910

(51) Int. Cl.[7] ..... H01R 13/40

(52) U.S. Cl. ..... 439/596

(58) Field of Search ..... 439/595, 752, 439/596, 940

(56) References Cited

U.S. PATENT DOCUMENTS 4,721,482 * 1/1988 Fukuda et al. ..... 439/595
5,067,913 * 11/1991 Maejima ..... 439/595
5,618,207 * 4/1997 Maejima ..... 439/595

* cited by examiner

*Primary Examiner*—Renee Luebke
*Assistant Examiner*—Phuong Chi Nguyen
(74) *Attorney, Agent, or Firm*—Perman & Green, LLP

(57) ABSTRACT

An electric connector (3) connectable, in a longitudinal assembly direction (A), to a complementary connector (2), and having an insulating casing (14) defining a number of longitudinal cavities (16) for housing respective electric terminals (17), and main retaining means (25) for retaining the terminals (17) in a correct insertion position inside the cavities (16) and having, for each terminal, a retaining seat (71) formed in the terminal (17), and an elastic lance (72) associated with the respective cavity (16) and which clicks onto the retaining seat (71); the connector (3) also has, for each terminal (17), a stop member (75) carried by the respective elastic lance (72) and movable, by virtue of the position assumed by the terminal (17) inside the respective cavity (16), between a disabling position disabling connection of the connector (3) to the complementary connector (2) and corresponding to a position in which the elastic lance (72) does not engage the retaining seat (71) and the stop member (75) interferes with the complementary connector (2), and an enabling position enabling connection of the connector (3) to the complementary connector (2), and which corresponds to correct insertion of the terminal (17) inside the cavity (16).

18 Claims, 5 Drawing Sheets

ELECTRIC CONNECTOR AND ELECTRIC CONNECTING UNIT FEATURING SUCH A CONNECTOR

The present invention relates to an electric connector, in particular for a circuit for activating a vehicle air-bag device, and to an electric connecting unit defined by connection of said connector to a complementary connector in an assembly direction.

Electric connectors of the above type are known to comprise an insulating casing defining a number of cavities having axes parallel to said assembly direction and for housing respective electric terminals, which are connected to respective electric cables and retained inside the cavities by main retaining means; and, for each cavity, the main retaining means comprise a retaining seat formed in the respective terminal, and an elastically deformable latch member forming part of the casing and which clicks onto the seat.

Such connectors also comprise auxiliary retaining means for determining correct insertion, and further ensuring retention, of the terminals inside the respective cavities.

The auxiliary retaining means normally comprise a movable member which clicks onto the casing and may either be hinged to and integral with the casing, or defined by a separate member. Whichever the case, the movable member only clicks onto the casing when all the terminals are inserted correctly and locked inside the respective cavities by the respective latch members. Conversely, if any one of the terminals is not properly or fully inserted, the main retaining means remain deformed, thus preventing assembly of the movable member and so enabling the fault to be detected.

Known connectors of the type briefly described above involve several drawbacks. In the event one of the terminals is not inserted fully inside the respective cavity, the movable member may be forced into the connecting position despite interference with the main retaining means, thus resulting, for example, in breakage or deformation of the contacting parts; and the connector so assembled may be connected to a complementary connector. In such cases, improper assembly of the terminal may go undetected during testing, on account, for example, of the terminal being so positioned as determine an albeit precarious electric contact which, in applications in which the connector is subjected to vibration, as on a vehicle, is bound to fail eventually, with all the obvious consequences this entails.

It is an object of the present invention to provide a straightforward, reliable, low-cost electric connector designed to eliminate the aforementioned drawback typically associated with known connectors.

According to the present invention, there is provided a connector as defined in claim 1.

The present invention also relates to an electric connecting unit as defined in claim 8.

A preferred, non-limiting embodiment of the present invention will be described by way of example with reference to the accompanying drawings, in which.

Figure 1:
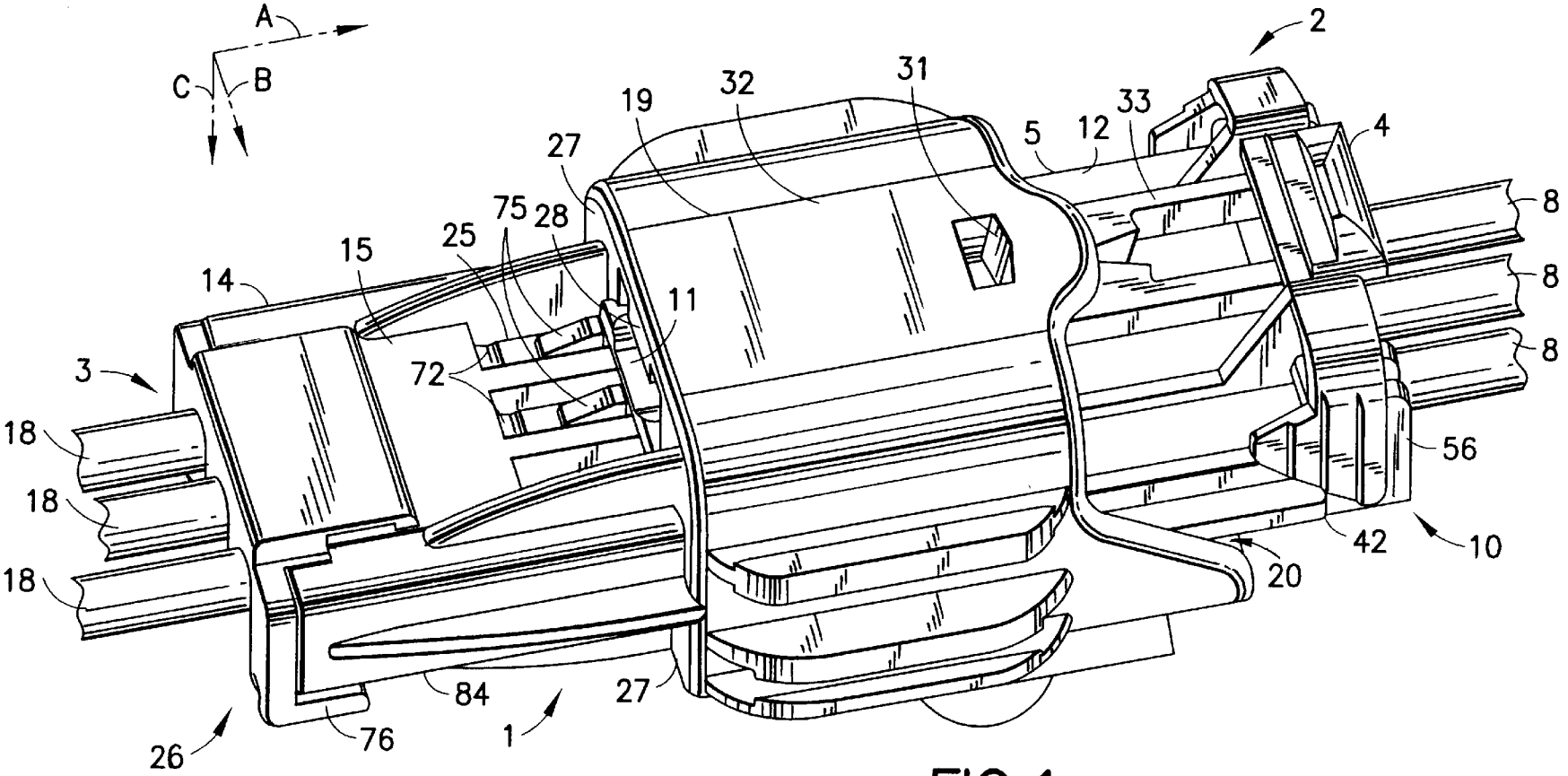
FIG. 1 shows a view in perspective of an electric connecting unit in accordance with the present invention in course of assembly.

With reference to FIGS. 1 to 5, number 1 indicates as a whole an electric connecting unit comprising two electric connectors 2, 3 connectable to each other in a longitudinal assembly direction A, and a device 4 for click-on connecting connectors 2, 3 in a final assembly position.

It should be stressed that the terms "top", "bottom", "front", "rear" and similar used in the following description are in now way limiting, and are used solely for the sake of clarity with reference to the position of unit 1 shown in FIGS. 1 to 5.

Connector 2 (FIGS. 1 to 6) comprises a substantially parallelepiped-shaped insulating casing 5 defining a number of—in the example shown, three—longitudinal through cavities 6 arranged side by side in a direction B perpendicular to direction A, and for housing respective female electric terminals 7 connected to respective electric cables 8. Connector 2 also comprises main retaining means 9 for retaining each terminal 7 in a correct insertion position inside respective cavity 6; and auxiliary retaining means 10 for determining correct insertion of terminals 7 inside cavities 6 and preventing withdrawal of the terminals.

Casing 5 comprises a plate 11 (for the purpose explained later on) projecting frontwards—substantially as an extension of a top wall 12 of casing 5 parallel to directions A and B—and having, on the outside, on the opposite side to cavities 6, two ribs 13 parallel to direction A.

Connector 3 (FIGS. 1 to 5 and FIG. 7) comprises an insulating casing 14 having a substantially parallelepiped-shaped rear portion 15 defining a number of—in the example shown, three—longitudinal cavities 16 for housing respective male electric terminals 17 connected to respective electric cables 18 and for connection to female terminals 7 of connector 2, and a hollow, substantially parallelepiped-shaped front portion 19 defining a compartment 20 for housing connector 2 and which is complementary in shape to casing 5 and communicates with cavities 16. Like connector 2, connector 3 also comprises main retaining means 25 for retaining each terminal 17 in a correct insertion position inside respective cavity 16; and auxiliary retaining means 26 for determining correct insertion of terminals 17 inside cavities 16 and preventing withdrawal of the terminals.

More specifically, portion 19 projects outwards on opposite sides of portion 15 in a direction C perpendicular to directions A and B, anci is connected to portion 15 by two walls 27 perpendicular to direction A and forming an extension of an end wall of compartment 20. One of walls 27 has a shaped through opening 28 engaged, in the final assembly position of connectors 2, 3, by plate 11, which projects from compartment 20 and is positioned contacting a top wall 29 of portion 15. Inside compartment 20, portion 19 also comprises two grooves 30 parallel to direction A and which are engaged in sliding manner by ribs 13 of plate 11 when assembling connectors 2 and 3, so as to define a guide for plate 11.

Figure 6:
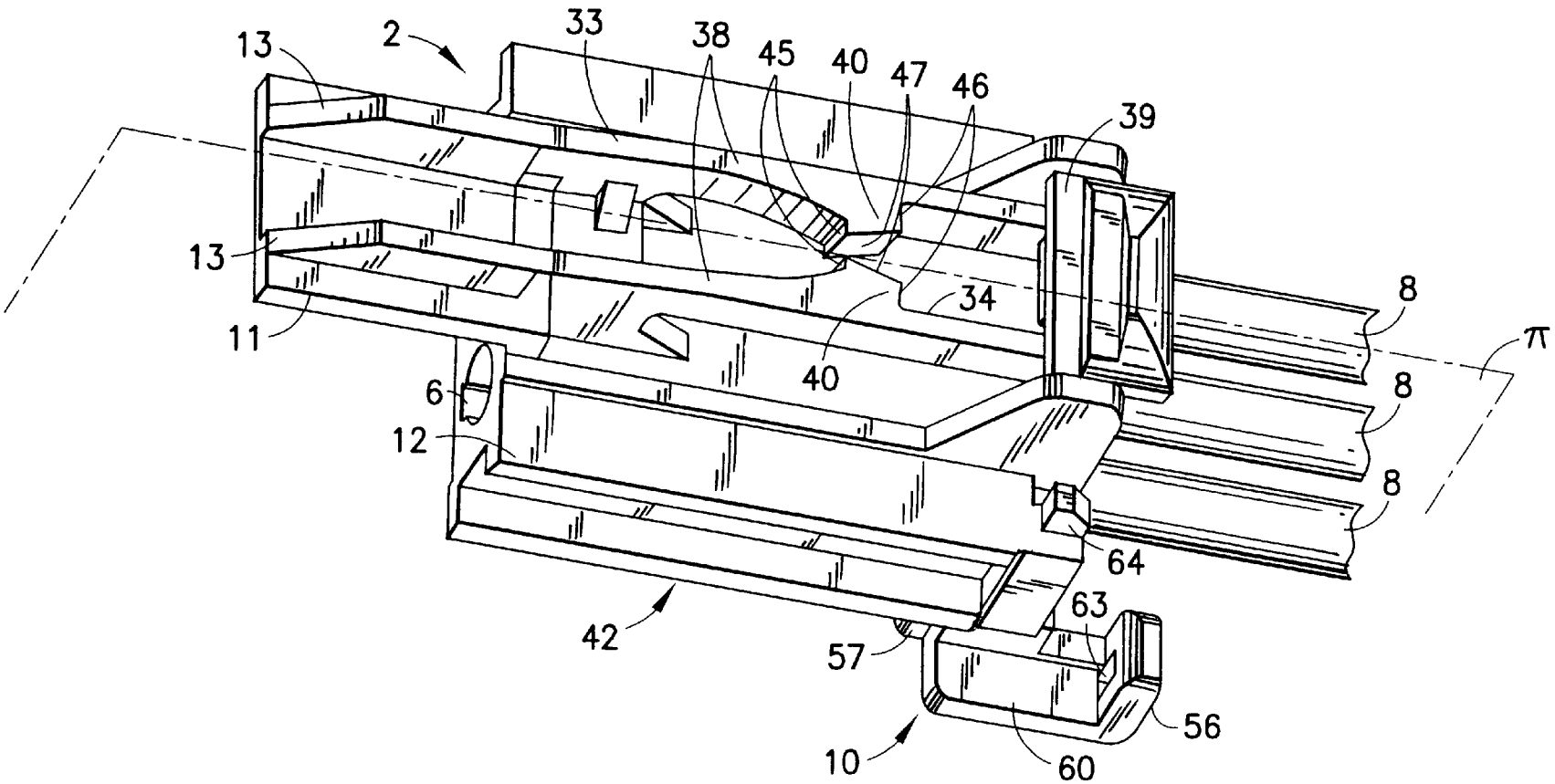
FIG. 6 shows a view in perspective of a first connector of the FIG. 1 unit.
Figure 7:
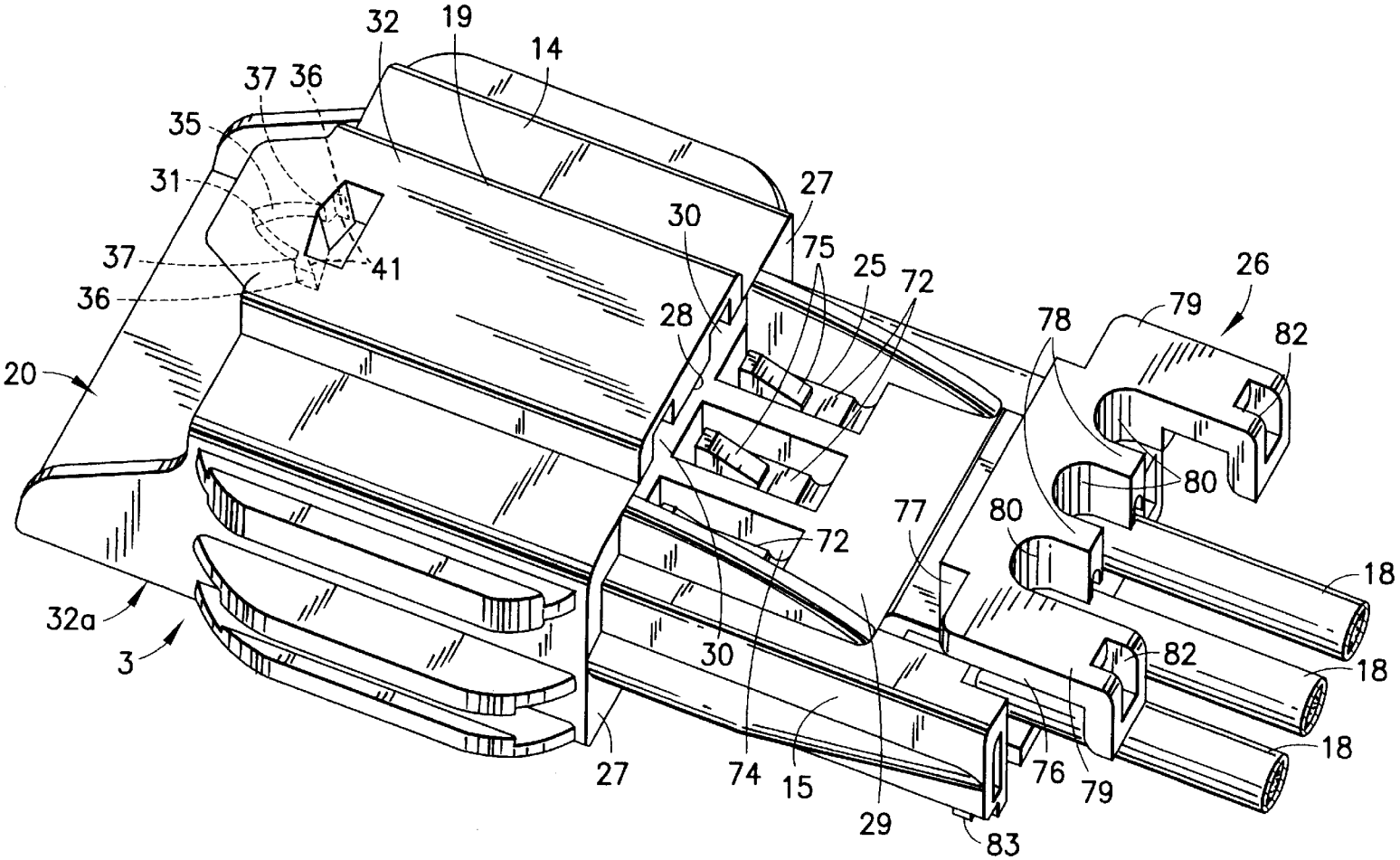
FIG. 7 shows a view in perspective of a second connector of the FIG. 1 unit.

With particular reference to FIGS. 1, 6 and 7, device 4 comprises a male member 31 located close to a front opening of portion 19 and projecting integrally inwards of compartment 20 of casing, 14 from a top longitudinal wall 32 of portion 19; and an elastic member 33, which projects longitudinally from an outer face of wall 12 of casing 5, has a seat 34 for retaining male member 31, and is flexible parallel to direction C to permit release of connectors 2, 3. When connecting connectors 2 and 3, male member 31 cooperates in sliding manner, in direction A, with seat 34 to engage seat 34 in a position corresponding to the final assembly position of connectors 2, 3.

More specifically, male member 31 is defined by a tooth comprising a wedge-shaped main portion 35, which in turn is defined by opposite substantially longitudinal, convex lateral surfaces, and, sectioned in a plane perpendicular to direction C, is substantially ogival in shape, tapering towards a pointed front end facing the front opening of portion 19. At the opposite end, male member 31 comprises two projections 36 projecting laterally from portion 35 and defining, towards the pointed end of portion 35, respective shoulders 37 substantially crosswise to direction A. More specifically, shoulders 37 slope slightly with respect to a plane perpendicular to direction A so as to converge towards the pointed end of portion 35. At the end opposite the pointed end, male member 31 is defined by two surfaces 41 substantially parallel to shoulders 37 and forming an obtuse dihedral angle.

Elastic member 33 comprises two substantially parallel longitudinal arms 38, which are symmetrical with respect to an intermediate plane π of connector 2, form extensions of ribs 13, and each have one end integral with a front transverse edge of wall 12. Respective free ends of arms 38 are connected integrally by a cross member 39 projecting outwards from casing 14 of connector 3 in the final assembly position of connectors 2, 3, and which is pressed manually in direction C towards wall 12 to permit release of connectors 2, 3.

Arms 38 comprise respective intermediate projections 40 symmetrical with respect to plane π, extending towards each other, and substantially in the form of right trapeziums with the oblique sides facing each other. Seat 34 has an axis parallel to direction A and lying in plane π, and is defined by projections 40 and by respective portions of arms 38 extending between projections 40 and cross member 39.

Arms 38 are flexible in a plane substantially perpendicular to direction C to permit insertion of male ember 31 inside seat 34.

More specifically, each projection 4) is defined by a lateral first surface 45 perpendicular to direction A and facing plate 11; by a lateral second surface 46 facing cross member 39 and sloping at the same angle as respective surface 41 of male member 31; and by a substantially longitudinal third surface 47 interposed between surfaces 45 and 46, sloping with respect to direction A, and defining a section of seat 34 increasing from surface 45 to surface 46

Surfaces 45 define a front opening of seat 34 and a temporary stop for shoulders 37 of male member 31 when connecting connectors 2, 3, so that the force required to connect connectors 2, 3 must be increased to a threshold value sufficient to click shoulders 37 past surfaces 45 and enable male member 31 to assume the engaged position in which surfaces 41 rest against surfaces 46 of seat 34.

Surfaces 47 are so formed as to exert elastic thrust on male member 31 to bring male member 31 irreversibly into the engaged position is projections 36 of male member 31 click past surfaces 45 when connecting connectors 2, 3.

With reference to FIGS. 2 to 5, each terminal 7 of connector 2 comprises a box-shaped front contact portion 48; a rear portion 49 for connection to respective electric cable 8; and an intermediate portion 50 extending between portions 48 and 49.

Each terminal 7 is inserted inside respective cavity 6 through a rear opening 51 of the cavity, from which cable 8 projects, and is positioned with contact portion 48 facing a front opening 52 of cavity 6.

Main retaining means 9 comprise, for each terminal 7, a retaining seat 53 formed in intermediate portion 50 of terminal 7; and an elastic lance 54, which projects inside respective cavity 6, towards front opening 52, from a bottom wall 42 of casing 5 parallel to wall 12, and clicks onto seat 53 by means of a Respective tooth 55 to retain terminal 7 in the correct insertion position inside cavity 6.

Each lance 54 interacts with respective terminal 7 so as to flex, parallel to director C, between an undeformed configuration corresponding to a position in which tooth 55 engages respective seat 53 and terminal 7 is inserted correctly inside respective cavity 6, and a deformed configuration in which the lance is flexed away from the axis of cavity 6.

Auxiliary retaining means 10 comprise a hatch-type movable member 56 integral with and extending the full width of casing 5, and hinged to a repair end of wall 42 to rotate between an open position permitting insertion of terminals 7 inside respective cavities 6, and a closed position, clicked onto casing 5, to prevent withdrawal of terminals 7 from respective cavities 6.

More specifically, movable member 55, viewed from the side, is substantially L-shaped, and comprises a substantially flat base portion 57 hinged to wall 42 and having, on the outside, two parallel longitudinal projections 58; and two pairs of arms 59, 60 projecting perpendicularly from portion 57 and defining a number of U-shaped through openings 61. When movable member 56 is, in the closed position, portion 57 extends parallel to wall 42, each arm 59 is located between a pair of adjacent cables 8, and each arm 60 is located outwards of an end cable 8, so that each opening 61 is engaged by a respective electric cable 8 and has a lateral edge facing connecting portion 49 of respective terminal 7 in direction A, which portion 49 projects radially with respect to cable 8. When movable member 56 is in the closed position, the lateral edges of openings 61 therefore define respective stops for portions 49, to prevent withdrawal of terminals 7 from respective cavities 6.

Movable member 56 is clicked into the closed position on casing 5 by retaining teeth 64—projecting from a rear end of wall 42—clicking inside respective end seats 63 on arms 60.

In the closed position of movable member 56, projections 58 of portion 57 cooperate in sliding manner with a wall 32*a*, opposite wall 32, of compartment 20 to permit connection of connectors 2 and 3 and, in the event of incorrect insertion of at least one of terminals 7 inside respective cavity 6, interfere with wall 32*a* to prevent connection of connectors 2 and 3. More specifically, when any one of terminals 7 is inserted improperly inside respective cavity 6, retaining teeth 64 are prevented from engaging seats 63 on arms 60 by portion 49 of terminal 7 interacting with the lateral edge of respective opening 61.

With reference to FIGS. 2 to 5, each terminal 17 of connector 3 comprises a box-shaped intermediate portion 66; a contact portion 67 projecting frontwards from portion 66 and which fits inside contact portion 48 of a respective female terminal 7; and a rear portion 68 for connection to respective electric cable 18.

Each terminal 17 is inserted inside respective cavity 16 through a rear opening 69 of the cavity, from which cable 18 projects in use, and is positioned with contact portion 67 projecting axially inside compartment 20 through a front opening 70 of cavity 16.

Main retaining means 25 comprise, for each terminal 17, a retaining seat 71 formed in intermediate portion 66 of terminal 17; and an elastic lance 72, which projects inside respective cavity 16 from wall 29 and parallel to direction A towards front opening 70, and clicks onto seat 71 by means of a respective tooth 73 to retain terminal 17 in the correct insertion position inside cavity 16.

Each lance 72 interacts with respective terminal 17 so as to flex, parallel to direction C, between an undeformed configuration corresponding to a position in which tooth 73 engages respective seat 71 and terminal 17 is inserted correctly inside respective cavity 16, and a deformed configuration in which the lance is flexed away from the axis of cavity 16.

According to the present invention, each lance 72 is located at a respective substantially rectangular through opening 74 in wall 29, and comprises an end projection 75 extending on the opposite side to tooth 73 and movable with lance 72—by virtue of the interaction between lance 72 and respective terminal 17, and, hence, of the position assumed by terminal 17 inside respective cavity 16—between two work positions respectively disabling and enabling connection of connectors 2 and 3. More specifically, in the disabling position corresponding to the deformed configuration of lance 72, projection 75 projects outwards of all 29 through respective opening 74 and interferes with the sliding movement of plate 11 of connector 2 along wall 29; whereas, in the enabling position corresponding to correct insertion of terminal 17 inside respective cavity 16 and to the undeformed configuration of lance 72, projection 75 engages opening 74 and is aligned with the outer edge of opening 74 to enable plate 11 of connector 2 to slide along wall 29.

More specifically, projection 75 of each lance 72 is substantially in the form of a right trapezium with the oblique side facing outwards of wall 29; and each lance 72 has a portion 65 connected to wall 29 on the opposite side of projection 75 to connector 2, so that, in the disabling position of projection 75, any attempt to force connection of connectors 2 and 3 results in plate 11 jamming against projection 75, thus preventing attainment of the final assembly position.

As in connector 2, auxiliary retaining means 26 comprise a hatch-type movable member 76 integral with and extending the full width of casing 14, and hinged to a rear end of wall 29 to rotate between an open position permitting insertion of terminals 17 inside respective cavities 16, and a closed position, clicked onto casing 14, to prevent withdrawal of terminals 17 from respective cavities 16.

More specifically, movable member 76, viewed from the side, is substantially L-shaped, and comprises a substantially flat rectangular base port on 77 hinged to wall 29; and two pairs of arms 78, 79 projecting perpendicularly from portion 77 and defiling a number of U-shaped through openings 80. When movable member 76 is in the closed position, portion 77 extends parallel to wall 29, each arm 78 is located between a pair of adjacent cables 18, and each arm 79 is located outwards of an end cable 18, so that each opening 80 is engaged by a respective electric cable 18 and has a lateral edge facing connecting portion 68 of respective terminal 17 in direction A, which portion 68 projects radially with respect to cable 18. When movable member 76 is in the closed position, the lateral edges of openings 80 therefore define respective stops for portions 68, to prevent withdrawal of terminals 17 from respective cavities 16.

Movable member 76 is clicked into the closed position on casing 14 by retaining teeth 83—projecting from a rear end of a bottom wall 84, parallel to wall 29, of portion 15—clicking inside respective end seats 82 on arms 79.

Figure 2:
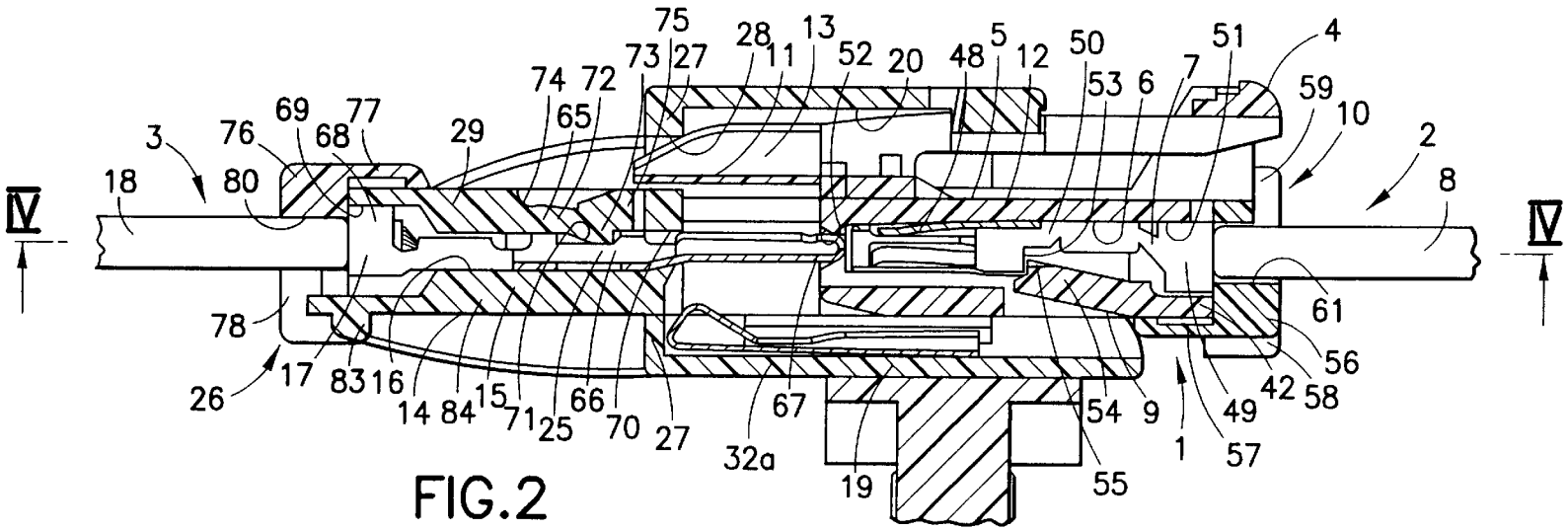
FIG. 2 shows a longitudinal section of the FIG. 1 unit.
Figure 4:
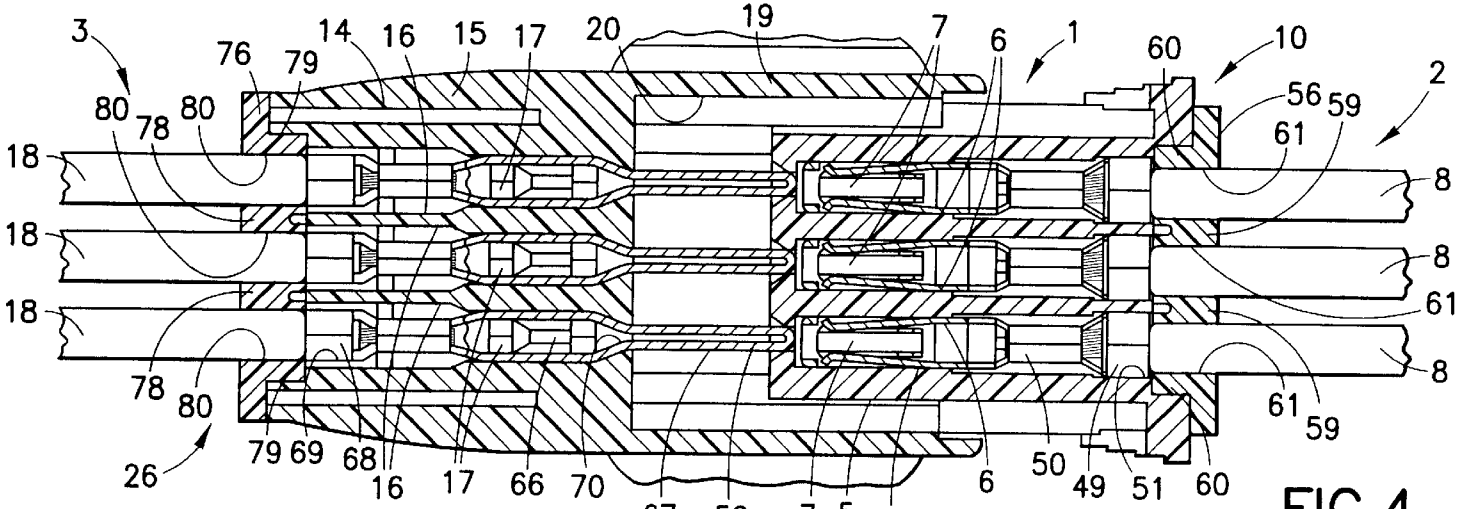
FIG. 4 shows a section along line IV—IV in FIG. 2.

Unit 1 is assembled by sliding connector 2 longitudinally in direction A inside portion 19 of connector 3, with terminals 7, 17 first inserted inside respective cavities 6, 16 and retained by respective lances 54, 72, and with movable members 56, 76 first clicked into the closed position on respective casings 5, 14 (FIGS. 1, 2 and 4).

If any one of terminals 7 is not inserted properly inside respective cavity 6, the respective lance 54 is maintained by terminal 7 in the deformed configuration in which tooth 55 is disengaged from seat 53 and, on account of the lateral edge of respective opening 61 interacting with connecting portion 49 cf terminal 7, teeth 64 are prevented from engaging seats 63 on arms 60, thus preventing movable member 56 from being clicked into the closed position. In which case, portion 57 of movable member 56 is inclined with respect to wall 42, and projections 58 interfere with wall 32*a* of compartment 20, thus preventing connector of connectors 2 and 3.

Figure 3:
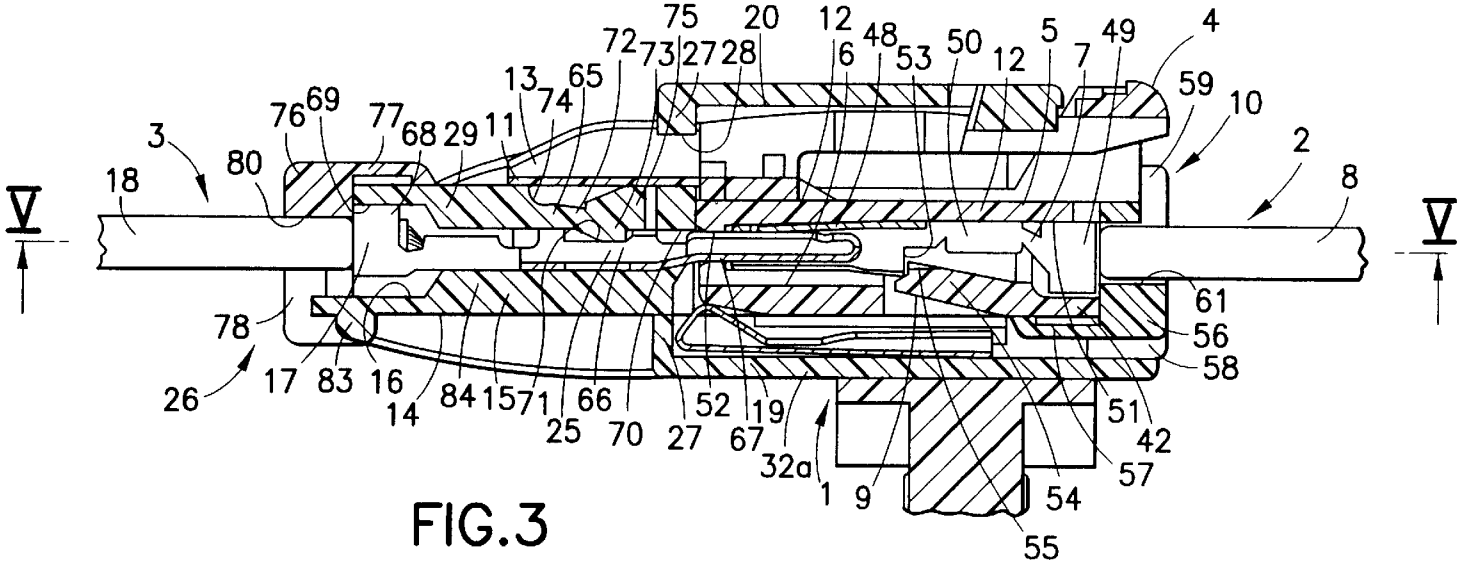
FIG. 3 shows a longitudinal section of the FIG. 1 unit fully assembled.
Figure 5:
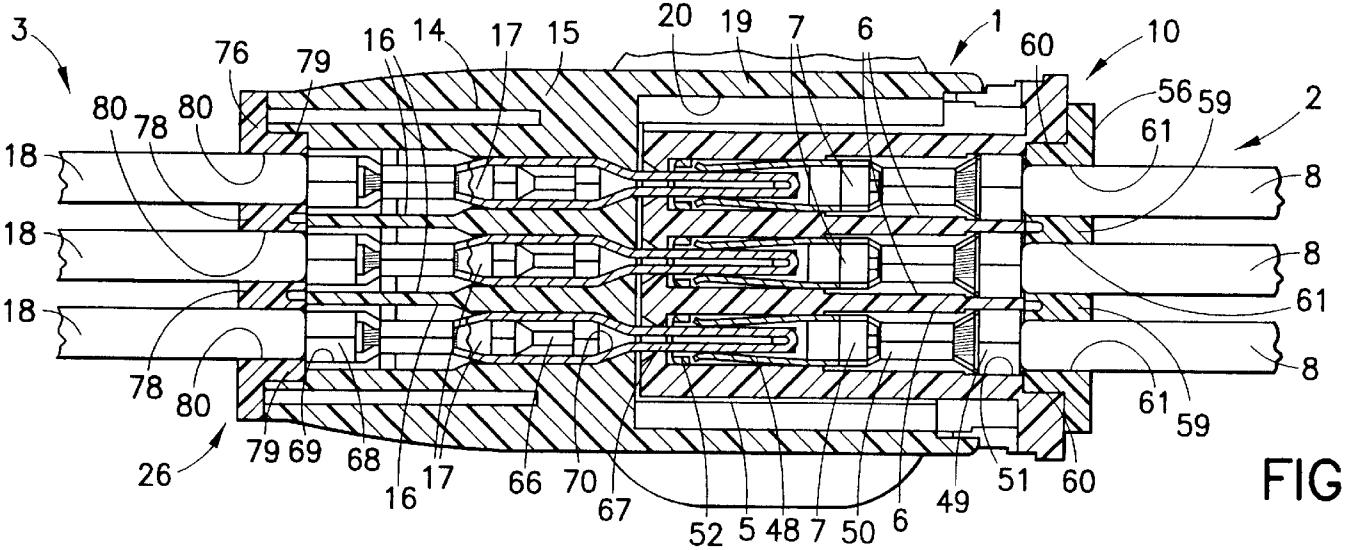
FIG. 5 shows a section along line V—V in FIG. 3.

Conversely, if terminals 7 are all inserted correctly inside respective cavities 6, i.e. with teeth 55 of lances 54 clicked inside seats 53, the lateral edges of openings 61 fit behind portions 49 of terminals 7 and surround cables 8, thus enabling movable member 56 to be clicked into the closed position wherein portion 57 extends parallel to wall 42, and projections 58 cooperate in sliding manner with wall 32*a* inside compartment 20 to enable connection of connectors 2 and 3 (FIGS. 3 and 5).

If any one of terminals 17 is not inserted properly inside respective cavity 16, the respective lance 72 is maintained by terminal 17 in the deformed configuration in which tooth 73 is disengaged from seat 71, and projection 75 is in the disabling position projecting outwards of wall 29 through respective opening 74 and interfering with the sliding movement of plate 11 of connector 2 along wall 29, thus preventing connection of connectors 2 and 3. Moreover, on account of the lateral edge of respective opening 80 interacting with connecting portion 68 of the improperly inserted terminal 17, teeth 83 are prevented from engaging seats 82 on arms 79, thus preventing movable member 76 from being clicked into the closed position.

Conversely, if terminals 17 are all inserted correctly inside respective cavities 16, i.e. with teeth 73 of lances 72 clicked inside seats 71, projections 75 are in the enabling position engaging respective openings 74, and are aligned with the outer edges of openings 74, thus enabling plate 11 of connector 2 to slide along wall 29 and, hence, connection of connectors 2 and 3. Moreover, in the above condition, the lateral edges of openings 80 fit behind portions 68 of terminals 17 and surround cables 18, thus enabling movable member 76 to be clicked into the closed position (FIGS. 3 and 5).

As connector 2 is slid longitudinally in direction A inside compartment 20 of connector 3, male member 31 is inserted inside seat 34 of elastic member 33; and, on account of portion 35 of male member 31 increasing in section towards projections 36, the gradual insertion of male member 31 inside seat 34 elastically deforms arms 38, which part in the plane perpendicular to direction C. At the initial connection stage, the elastic reaction of arms 38—by virtue of the shape of male member 31—is such as to repel connectors 2 and 3, sc that, if any one of terminals 7 and/or 17 is not inserted properly inside respective cavity 6, 16 so that projections 58 of movable member 56 interfere with wall 32*a* of compartment 20 and/or projection 75 of respective lance 72 interferes with plate 11, connectors 2 and 3 are immediately repelled in direction A in the opposite sense to that of assembly.

Upon shoulders 37 of male member 31 coming to rest against respective surfaces 45 of projections 40, surfaces 45 temporarily arrest male member 31, so that additional thrust is required to elastically part arms 38, which are subjected to a transverse thrust component on account of the slope of shoulders 37 If the thrust applied exceeds a threshold value defined by the geometry of the contacting surfaces and by the characteristics of the material used, projections 36 of male member 31 click past surfaces 45 to click male member 31 into the engaged position corresponding to the final assembly position of connectors 2, 3.

As projections 36 click past surfaces 45 and arms 38 begin returning to the undeformed position, surfaces 47, by defining a portion of seat 34 increasing in section towards cross member 39, exert thrust on male member 31 to push male member 31 irreversibly into the engaged position.

To disconnect connectors 2, 3, cross member 39 is simply pushed in direction C to release surfaces 46 of projections 40 from respective surfaces 41 of male member 31.

The advantages of unit 1 and connector 3 according to the present invention will be clear from the foregoing description.

In particular, if any one of terminals 17 of connector 3 is not inserted properly inside respective cavity 16, the respective lance 72 is maintained by terminal 17 in the deformed configuration, and projection 75 projects outwards of wall 29 to prevent plate 11 of connector 2 from sliding along wall 29 and, hence, connection of electric connectors 2 and 3. Consequently, even if movable member 76 is forced into the closed position, the presence of an improperly inserted terminal 17 would still be detected when assembling connector 3 to connector 2.

The above characteristic, combined with movable member 56 of connector 2 comprising projections 58 for preventing insertion of connector 2 inside compartment 20 of connector 3 with movable member 56 in other than the closed position (terminals 7 not properly inserted), provides for extremely safe connection and a high degree of reliability of unit 1.

Finally, the resistance offered by surfaces 45 of elastic member 33 to insertion of male member 31 inside seat 34 ensures expulsion of connector 2 from compartment 20 in the event one or more terminals 7, 17 are not properly inserted inside respective cavities 6, 16, thus preventing forcing of the contacting parts.

Clearly, changes may be made to unit 1 as described herein with out, however, departing from the scope of the present invention.

What is claimed is:

1. An electric connector connectable in an assembly direction to a complementary second connector, the electric connector comprising:

an insulating casing defining at least one cavity having an axis parallel to said assembly direction, said casing housing a respective electric terminal; and main retaining means for retaining said terminal in a correct position for insertion inside said cavity, said main retaining means comprising a seat member associated with one of said terminals and said cavity, and at least one lance member associated with the other of said terminal and said cavity (16), and further which clicks onto said seat member;

further including stop means carried by one of said lance members and said casing, and movable by virtue of the position assumed by said terminal inside said cavity, between a first and a second work position to respectively disable and enable connection of said connector to said complementary connector; said stop means interfering with said complementary connector in said first work position, corresponding to a release position of said lance member and said seat member; and said second work position being assumed when said terminal is in said correct insertion position inside said cavity.

2. An electric connector as claimed in claim 1, further comprising auxiliary retaining means for ensuring said terminal is in said correct insertion position inside said cavity, and also for preventing withdrawal of the terminal.

3. An electric connector as claimed in claim 1, wherein said lance member projects inwards of said cavity from a wall of said casing in a direction substantially parallel to said assembly direction of said connectors and is located at a through opening in said casing wall; and further that said stopping mechanism comprises a projection from said lance member projecting outwards from said wall in said first work position so as to interfere with a coupling portion, cooperating in a sliding manner with said wall, of said second connector.

4. An electric connector as claimed in claim 3, wherein said lance member comprises a connector portion connected to said wall and located on the opposite side of said projection with respect to said second connector, so as to determine, in said first work position of said projection, interference between said projection and said coupling portion of said second connector.

5. An electric connector as claimed in claim 3, wherein said projection defines a free end of said lance member.

6. An electric connector as claimed in claim 3, wherein said projection is substantially in the form of a right trapezium with the oblique side facing outwards of said wall.

7. An electric connector as claimed in claim 3, wherein said retaining means comprise a seat member formed in said terminal; and further in that said lance member comprises a tooth member located on the opposite side of said projection, said tooth member clicking onto said seat member in said correct insertion position of said terminal inside said cavity.

8. An electric connecting unit comprising a first and a second electric connector mutually connectable in an assembly direction to a final assembly position; said first connector comprising:

a first insulating casing defining at least one first cavity having an axis parallel to said assembly direction and for housing a first electric terminal; and a first main retaining means for retaining said first electric terminal in a correct insertion position inside said first cavity, and comprising a seating means associated with one of said first electric terminal and said first cavity, and further at least one lance member associated with the other of said first electric terminal and said first cavity, said lance member clicking onto said seating means;

further comprising a stopping means carried by one of said lance member and said first insulating casing and movable, by virtue of the position assumed by said first electric terminal inside said first cavity, between a first and a second work position to respectively disable and enable connection of said first and said second connector; said stopping means interfering with said second connector in said first work position, corresponding to a release position of said lance member (72) and said seating means; and said second work position being assumed when said first electric terminal is in said correct insertion position inside said first cavity.

9. A unit as claimed in claim 8, wherein said first connector comprises first auxiliary retaining means for ensuring said first electric terminal is in said correct insertion position inside said first cavity, and also for preventing withdrawal of the first electric terminal.

10. A unit as claimed in claim 8, wherein said male member is defined by a tooth projecting from a third wall of said first insulating casing, and comprises a main portion, and a pair of lateral third projections defining respective shoulders; said elastic member extending from said second insulating casing and comprising a pair of elastic arms defining said retaining seat and respective mating surfaces for said shoulders.

11. A unit as claimed in claim 8, wherein said first and said second insulating casing comprise a number of said first and said second cavities for said first and said second electric terminals.

12. A unit as claimed in claim 8, wherein said lance member projects inwards of said first cavity from a first wall of said first insulating casing and in a direction substantially parallel to said assembly direction, and further is located at a through opening in said first wall; and in that said stopping means comprise a first projection carried by said lance member, which projects outwards from said first wall in said first work position so as to interfere with a coupling portion, cooperating in a sliding manner with said first wall, of second connector.

13. A unit as claimed in claim 12, wherein said lance member comprises a connecting portion connected to said first wall and located on the opposite side of said first projection with respect to said second connector, so as to determine, in said first work position of said first projection, interference between said first projection and said coupling portion of said second connector.

14. A unit as claimed in claim 8, further comprising click-on connecting means for click-on connecting of said first and said second connectors, said click-on connecting means being defined by a retaining seat carried by said second connector, and by a male member carried by said first connector and which, during connection of said first and said second connector, cooperates in a sliding manner, in said assembly direction, with said retaining seat to engage said retaining seat in an engaged position corresponding to said final assembly position of said first and said second connector; said male member having at least one lateral shoulder substantially crosswise to said assembly direction; and said retaining seat having for said shoulder at least one mating surface substantially crosswise to said assembly direction and defining a temporary stop for said shoulder during connection of said first and said second connector, so that the force required to connect said first and said second connector must be increased to a threshold value sufficient to click said shoulder past said mating surface and enable said male member to assume said engaged position.

15. A unit as claimed in claim 14, wherein at least one of said male member and said retaining seat is integral with an elastic member projecting outwards from one of said first and said second insulating casings and further flexible in a direction crosswise to said assembly direction to permit release of said first and said second connector.

16. A unit as claimed in claim 8, wherein said second connector comprises a second insulating casing defining at least one second cavity having an axis parallel to said assembly direction, said second cavity housing a second electric terminal connectable to said first electric terminal; second main retaining means for retaining said second electric terminal in a correct insertion position inside said second cavity; and second auxiliary retaining means comprising at least one movable member connectable to said second insulating casing in a closed position to ensure said second electric terminal is in said correct insertion position inside said second cavity, and further to prevent withdrawal of the second electric terminal; said unit further comprising disabling means for disabling connection of said first and said second connector, and which are interposed between said movable member and said first insulating casing, and are deactivated by the movable member in said closed position.

17. A unit as claimed in claim 16, wherein said first insulating casing defines a housing for housing said second connector, and which is complementary in shape to said second insulating casing; and further in that said movable member is defined by a hatch-type member hinged to said second insulating casing so as to rotate between an open position permitting insertion of said second electric terminal inside said second cavity, and a closed position in which the hatch-type member clicks onto said second insulating casing to prevent withdrawal of said second electric terminal from said second cavity; said disabling means comprising at least one second projection carried by said movable member and which cooperates in a sliding manner with a second wall of said housing in said closed position of said movable member and interferes with the second wall in positions of said movable member other than said closed position.

18. A unit as claimed in claim 17, wherein said movable member, when viewed laterally, is substantially L-shaped, and comprises a substantially flat base portion hinged to said second insulating casing and having, on the outside, a pair of said second projections; and at least two arms projecting perpendicularly from said base portion and defining a U-shaped through opening which is engaged by an electric cable connected to said second electric terminal; and further said base portion and said second projections being parallel to said assembly direction of said connectors in said closed position of said movable member, and being inclined with respect to said assembly direction of said connectors when said second electric terminal is inserted incorrectly inside said second cavity.

* * * * *